US009280864B2

(12) United States Patent
D'Amico et al.

(10) Patent No.: US 9,280,864 B2
(45) Date of Patent: Mar. 8, 2016

(54) GAMING AWARD METHOD AND APPARATUS

(75) Inventors: Michael H. D'Amico, Las Vegas, NV (US); Stephanie Maddocks, Las Vegas, NV (US)

(73) Assignee: ARISTOCRAT TECHNOLOGIES, INC

( * ) Notice: Subject to any disclaimer, the term of this patent is extended or adjusted under 35 U.S.C. 154(b) by 0 days.

(21) Appl. No.: 13/070,167

(22) Filed: Mar. 23, 2011

(65) Prior Publication Data

US 2011/0172005 A1 Jul. 14, 2011

Related U.S. Application Data

(63) Continuation of application No. 12/970,476, filed on Dec. 16, 2010, now Pat. No. 8,328,630, which is a continuation of application No. 10/274,941, filed on Oct. 21, 2002, now abandoned.

(51) Int. Cl.
*G07F 17/32* (2006.01)

(52) U.S. Cl.
CPC ..... *G07F 17/32* (2013.01); *G07F 17/3239* (2013.01); *G07F 17/3255* (2013.01); *G07F 17/3267* (2013.01)

(58) Field of Classification Search
CPC .. G07F 17/32; G07F 17/3255; G07F 17/3239
USPC ..... 463/20, 25, 29, 42
See application file for complete search history.

(56) References Cited

U.S. PATENT DOCUMENTS 5,766,075 A 6/1998 Cook et al.
5,816,918 A * 10/1998 Kelly et al. ..... 463/16
6,015,344 A * 1/2000 Kelly et al. ..... 463/16
6,217,448 B1 4/2001 Olsen
6,231,445 B1 5/2001 Acres
6,280,328 B1 8/2001 Holch
6,302,793 B1 10/2001 Fertitta, III et al.
6,319,122 B1 11/2001 Packes
6,334,614 B1 1/2002 Breeding
6,358,149 B1 3/2002 Schneider (Continued)

FOREIGN PATENT DOCUMENTS

DE 19624321 A1 1/1998
EP 360613 A2 3/1990
WO WO 03/045520 A 6/2003

OTHER PUBLICATIONS

International Search Report, in International application No. PCT/US03/33352, dated Sep. 7, 2004. (1 page).
European Patent Office, Supplementary European search report for application No. 03776489.1-2221, dated Apr. 1, 2010. (2 pages).

(Continued)

*Primary Examiner* — Dmitry Suhol
*Assistant Examiner* — David Duffy
(74) *Attorney, Agent, or Firm* — McAndrews, Held & Malloy, Ltd.

(57) ABSTRACT

A gaming system providing a tiered reward bonus promotion. A player's activity level is quantified to a value that adjusts over time. The value at the completion of a bonus period is compared to a plurality of tier values stored in memory at the central authority. Each tier value has an associated bonus award that is awarded to the player if the player reaches that tier at the completion of the bonus period. The award is indicated in the player's account and may be redeemed at a player kiosk.

9 Claims, 4 Drawing Sheets

(56) References Cited

U.S. PATENT DOCUMENTS

| | | | | |
|---|---|---|---|---|
| 6,575,832 | B1 * | 6/2003 | Manfredi et al. | 463/25 |
| 2001/0055990 | A1 | 12/2001 | Acres | |
| 2002/0111210 | A1 * | 8/2002 | Luciano et al. | 463/29 |
| 2002/0151359 | A1 | 10/2002 | Rowe | |
| 2003/0032474 | A1 * | 2/2003 | Kaminkow | 463/25 |
| 2003/0105663 | A1 * | 6/2003 | Steinman et al. | 705/14 |
| 2003/0176219 | A1 | 9/2003 | Manfredi et al. | |
| 2004/0002386 | A1 * | 1/2004 | Wolfe et al. | 463/42 |
| 2004/0092315 | A1 * | 5/2004 | Boyd et al. | 463/42 |

OTHER PUBLICATIONS

European Patent Office Action in European application No. 03776489.1-2221, dated Jul. 26, 2010. (2 pages).

European Patent Office Action in European application No. 03776489.1-2221, dated May 10, 2011. (5 pages).

European Patent Office, Result of consultation, in European application No. 03776489.1-2221, dated Oct. 21, 2011. (3 pages).

European Patent Office, Result of consultation, in European application No. 03776489.1-2221, dated Jan. 17, 2012. (9 pages).

European Patent Office Action in European application No. 03776489.1-2221, dated Oct. 21, 2011. (7 pages).

* cited by examiner

GAMING AWARD METHOD AND APPARATUS

RELATED APPLICATIONS

This application is a continuation of U.S. application Ser. No. 12/970,476, filed Dec. 16, 2010, now U.S. Pat. No. 8,328,630, issued Dec. 11, 2012, which is a continuation of abandoned U.S. application Ser. No. 10/274,941, filed Oct. 21, 2002, both of which are incorporated herein by reference in their entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to gaming systems, and more particularly relates to a method and apparatus for encouraging play at gaming machines, and other types of non-machine gaming locations, by awarding bonuses to players based on the extent of player activity at the gaming location or other criteria.

Gaming machines offer various awards for play, including a cash award, a point award convertible to cash, a complementary award convertible to goods or services (e.g., food or lodging), but typically not to cash, and an award of a play of a bonus game. For example, U.S. Pat. No. 5,761,647 (Boushy, issued Jun. 2, 1998) describes the award of points and complementaries. U.S. Pat. No. 6,375,567 describes an award of a secondary game.

The prior art discloses bonus awards of various types. For example, in one type of bonus promotion, a bonus pool is developed from a percentage of coins played on a group of gaming machines. This pooled amount is awarded as a bonus to the player who obtains a designated reel combination.

Another type of bonus promotion is described in U.S. Pat. No. 6,231,445 in which a preset amount of money is awarded at a randomly selected gaming machine after a certain number of coins have been played throughout the casino.

The '445 patent discloses another type of bonus promotion which involves an award upon a random number of coins being played throughout the casino. The "mystery" number of coins needed to trigger the bonus award is randomly selected, within a range, prior to the promotion. The winner of the promotion is the player whose coin caused the threshold to be met of the total number of coins throughout the casino that needed to be played.

The '445 patent describes another type of bonus promotion in which the jackpot amount awarded for conventional play is changed to a multiple of the jackpot amount for that gaming machine. This multiple jackpot award occurs for a small period of time, about 60 seconds, and is initiated by the insertion of a special card in a designated card reader.

The '445 patent describes a "welcome back" bonus which grants a player half price wagering at a later time, if the player wagers a certain amount of money. For example, if the player wagers $600, then the player is allowed $8.00 of half price wagering the following day.

The '445 patent describes a personal progressive bonus. This bonus allows the player to play on several different gaming machines and still allow the bonus to be obtained. The player uses a player card to permit the system to track the player's contribution to the player's own person progressive bonus amount. This amount then is eligible to be won only by the player.

Another type of bonus promotion is described in U.S. Pat. No. 6,231,445 in which a selected reel combination of the gaming machine is used as a trigger event for a bonus award. During a predetermined period of time, an initial bonus amount is continuously decremented in value until one of the players is first to obtain the particular reel combination.

However, none of the foregoing patents provides to a player a tier of rewards based on the player's activity at many different game locations during a period of time. This deficiency may decrease the level of interest in play (i) due to the player's inability to compete with himself or herself in pursuit of an award, or (ii) due to the potential that another player will win the award caused in part by the player's gaming actions. This invention addresses the problems presented by the foregoing patents and provides a solution.

BRIEF SUMMARY OF THE INVENTION

It is therefore an object of the present invention to provide a bonusing promotion which increases play at gaming machines or non-machine gaming locations.

It is another object of the present invention to offer players the ability to obtain bonuses upon reaching defined levels or ranks of play.

These and other objects are achieved in a method and apparatus for conducting a bonus promotion in a networked system of a plurality of gaming machine and/or non-machine gaming locations. A player's activity level is quantified to a value that increases over a period of time. The value is compared to a plurality of tier values stored in memory at the central authority, at the time of a trigger event, as for example, the end of a bonus period. Each tier value has an associated bonus prize that is awarded when the player's activity level reaches the tier. The award is indicated in the player's account and may be redeemed at a player kiosk

DETAILED DESCRIPTION OF THE INVENTION

Figure 1:
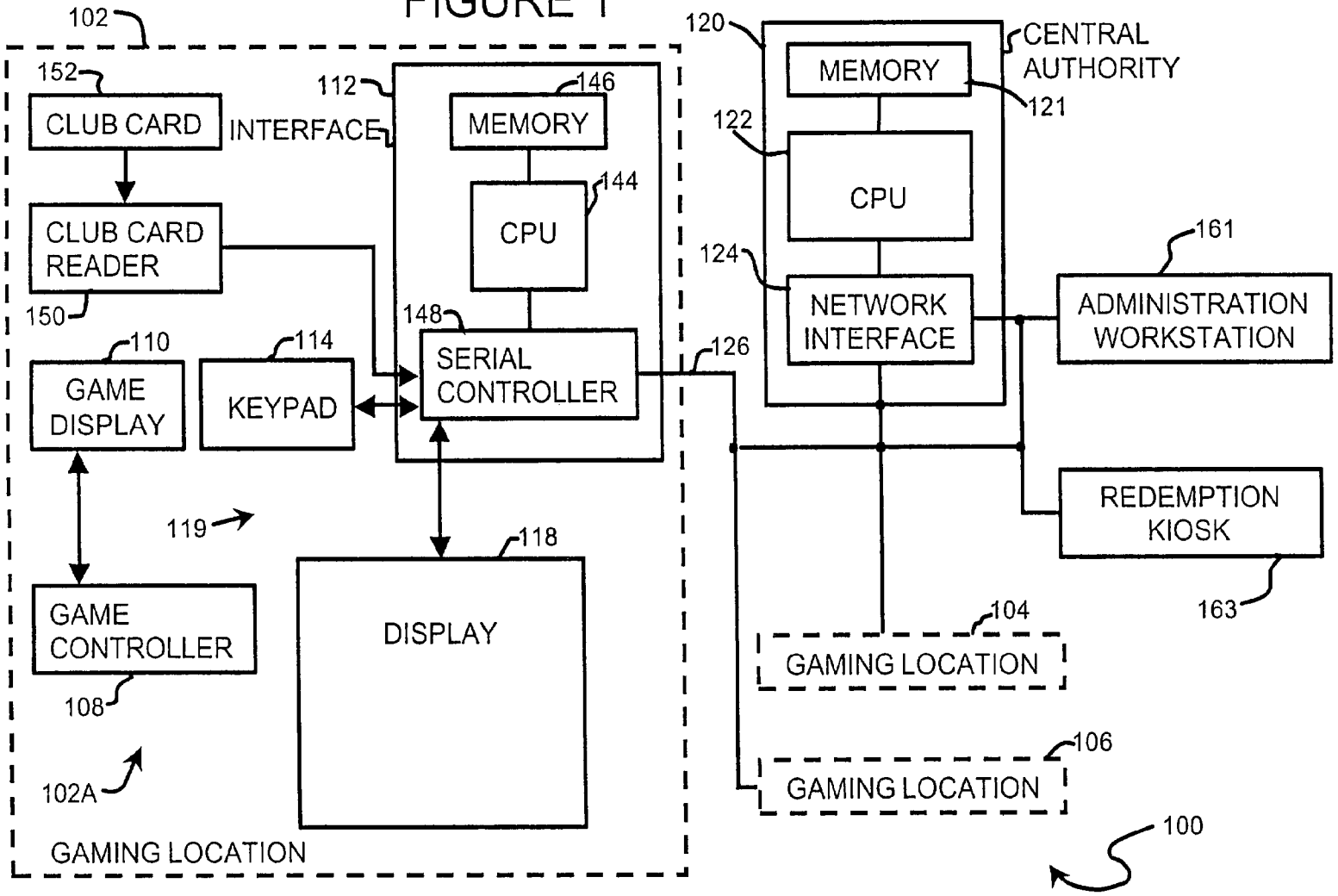
FIG. 1 is a schematic block diagram of one form of gaming system employing a tier award method in accordance with one form of the invention.

Referring to FIG. 1, a gaming system 100 includes a plurality of gaming locations 102, 104 and 106, each location being coupled to a central authority 120 via a network 126. Each gaming location 102, 104 and 106 may include a non-machine game, such as craps and blackjack, or may include a gaming machine, such as a slot machine, a video poker machine, a video roulette machine, and the like.

Gaming location 102 is exemplary of a gaming location having a gaming machine. Gaming location 102 includes a gaming machine 102A comprised of a game controller 108 and a game display 110. Also included is a communication interface 112, an optional alphanumeric keypad 114 and a display 118. Display 118 may comprise a touch screen liquid crystal display (LCD).

Display 118 is coupled to or located inside the cabinet (not shown) of gaming machine 102A, and may, for example, take the form of a rectangle about 3 inches high and 4 inches wide. Using an LCD in order to display graphics images and to display a numeric or alphabetic input image is advantageous because it eliminates the need for a separate keypad for the interactive entry of data. An optional alphanumeric keypad 114, however, may be placed for convenient manipulation while a player is using gaming location 102.

A conventional graphics display controller (not shown) is included at location 102 for controlling display 118. The controller can display either vector graphics or bit-mapped graphics on display 118, depending on the type of application program stored in a memory 146 of interface 112 used for graphic display and the type of data stored for purposes of generating graphics images. The image data resulting in graphics images can be stored in memory 146 or can be stored in a memory 121 of the central authority 120 and transmitted via network 126 to the display controller for a particular graphic image. The image data can be either vector data or bit-mapped data. A central processing unit (CPU) 144 controls the transfer of the image data to the display controller in response to application programs stored in memory 146 that determine the location of the graphics images on display 118 and also determine the time at which the graphics displays are presented.

Interface 112, optional keypad 114, the display controller and display 118 comprise an interactive communication unit 119. Each of the gaming locations 104 and 106, which may be a non-machine gaming location, include an interactive communication unit like unit 119. In one embodiment, a player enters alphabetic and numeric information by touching display 118. In such an embodiment, keypad 114 may not be provided. For the non-machine gaming locations, interface 112 comprises a communication controller 148, such as a modem.

In this specification, "interactive" means capable of accepting input from a human. Communication unit 119 comprises one or more programs for accepting such input from, for example, a touch screen alphanumeric image. Such programs are well known to those skilled in computer communication.

For a gaming machine location, interface 112 may include, for example, an RS485 interface such as that implemented by a Sentinel™ Interface from Aristocrat Technologies, Inc. Other interfaces and network architectures (e.g., Ethernet, parallel port, and the like) may be substituted however. Furthermore, interface 112 may implement, for example, the IGT Gaming SAS™ communication protocol or the CDS GDAP™ communication protocol for communication with gaming machine 102A, or may implement a custom communication protocol.

Game controller 108 is responsible for operation of the gaming machine 102A. Thus, the game controller may include a microprocessor, memory, game software, and support circuitry to implement a slot machine or other type of game. The display 110 provides displays necessary for the play of the game, such as a display of slot machine reels.

Gaming location 102 also includes a club card reader 150 that can read a MAG number located on a magnetic stripe of a club card or player card 152, which may, for example, be a smart card. The MAG number is unique for each player. Card 152 also sometimes bears a player ID number that is human readable, but is not machine-readable. The card reader 150 sends the MAG number to central authority 120, which converts the MAG number to an OCR number. This feature prevents any potential misuse due to fraudulent creation of a bogus player card. Memory 121 maintains a table that correlates OCR numbers with player ID numbers.

Central authority 120 translates an OCR number to a corresponding player ID number. This feature allows a single player ID number to identify more than one OCR number. The player ID number can be used by the central authority to address the value of an account corresponding to the player ID number or to access player activity points or other player activity data. Thus, the central authority keeps an account value and activity data corresponding to the player ID number, correlated with the OCR number by a table.

Player cards are generated by having a player fill out a form and by submitting the form to a clerk at a station that is equipped with a card creator (not shown). Typically, a card creator is located at only one or two work stations (not shown) within a gambling facility. The clerk keys information into the station, and the information is transmitted to central authority 120, which then generates an OCR number, corresponding MAG number and player ID number for the creation of a new player card. The OCR number and player ID number are stored in the data based in memory 121 in the manner previously described. The central authority then causes the card creator to create a new player card with the MAG number. Once the MAG, OCR and player ID numbers are created, they cannot be changed by a person operating outside system 100.

Central authority 120 includes a central processing unit (CPU) 122 that operates through a network interface 124 and a network 126 to enable communication of activity data from gaming locations 102, 104 and 106. Network 126 may be a conventional local area network, which allows data to be sent directly between any of gaming locations 102, 104 and 106, and central authority 120. Memory 121 also may store data related to awards. Alternatively, the data for the award may be stored locally in the memories for each of the gaming locations, such as memory 146.

As understood, central authority 120 may be comprised of a number of computers or processors, including personal computers, servers, work stations or floor controllers.

Communication unit 119 generates a data message to central authority 120 based on the player's activity at the gaming location. The data message carries information of the player's activity at the gaming location, for example, the number of coins wagered at location 102. A data message is generated at the time the player removes the player card from card reader 150. Also, the data message may be generated every hour to provide earlier updates of data where the player stays at a location 102 for a long period of time. The data message may include the player ID number which may be stored in memory 146 by the central authority after the player has inserted his or her player card into card reader 150.

The data message is transmitted via controller 148 and network 126 to central authority 120. The central authority responds to the message including updating of player activity data in the player account in memory 121, i.e., in the particular account identified by the player card inserted into card reader 150.

As shown in FIG. 1, an administration work station 161 is connected to central authority 120 via network 126. The operator of the system uses workstation 161 to enter parameters for the system including parameters for the tiered reward promotion. Work station 161 includes an interactive communication unit like unit 119. The operator enters alphabetic and numeric information by touching a display. A keypad may be provided as well to enter information. Workstation 161 includes a CPU and memory, in order to provide interactive prompts to the operator to obtain from the operator the desired parameters for the tiered reward promotion. Such parameters are sent to central authority 120 for storage in memory 121.

As shown in FIG. 1, a redemption kiosk 163 is connected to central authority 120 via network 126. A player may use kiosk 163 to view his or her player account including a display of the bonus awards won from the tiered reward promotion. Redemption kiosk 163 includes an interactive communication unit like unit 119. The player enters alphabetic and numeric information by touching a display. A keypad may also be used to enter information. Kiosk 163 includes a CPU and memory, in order to provide interactive prompts to the player to display to the player information regarding the player's account, as well as to provide for redemption of the awards won by the player from the tiered reward promotion. Such redemption may occur, for example, through printing of vouchers at kiosk 163, sending electronic food confirmation messages to hotel restaurants, dispensing actual prizes at kiosk 163, and the like.

Figure 2:
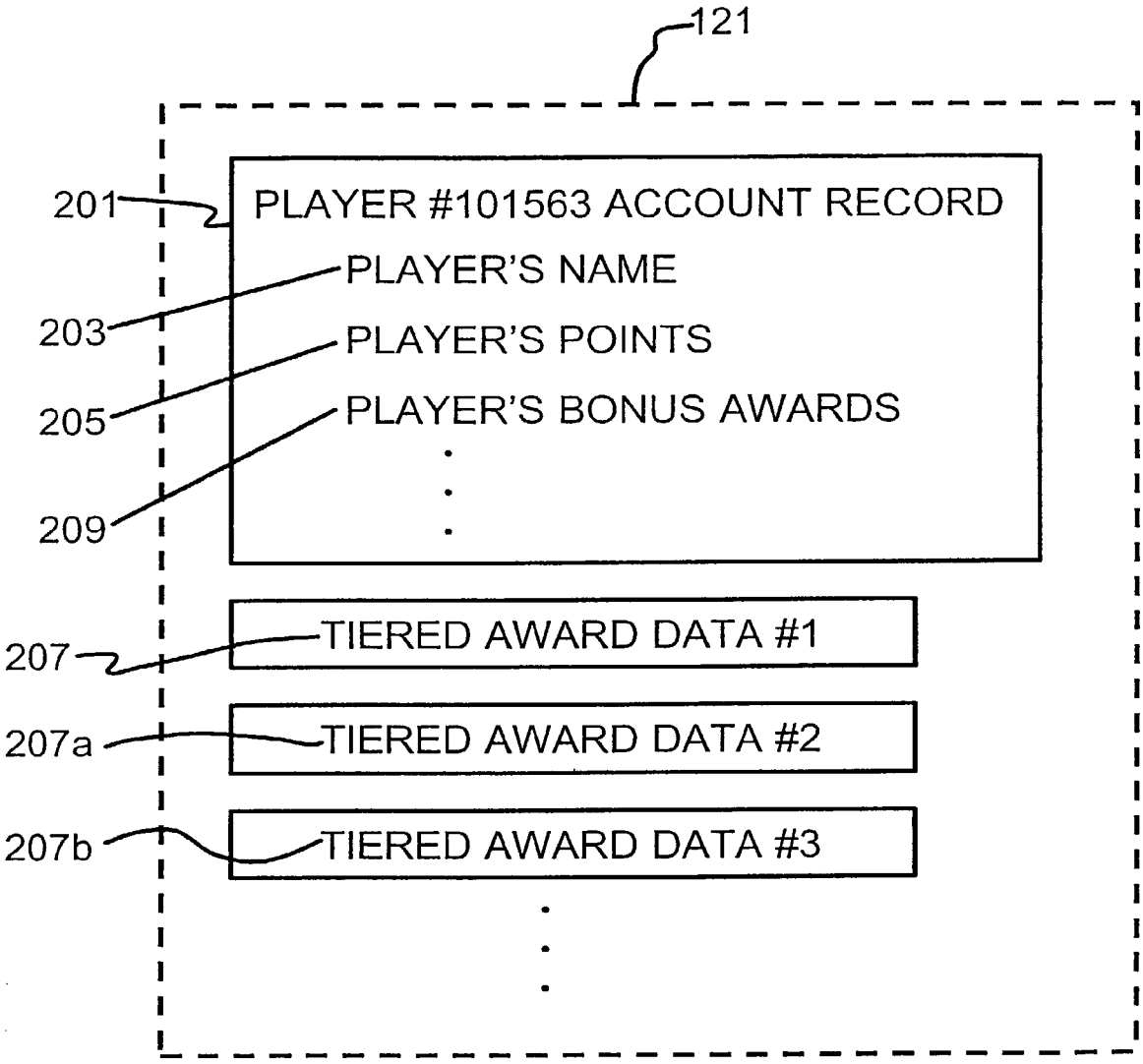
FIG. 2 is a block diagram representation of data stored in memory in the gaming system of FIG. 1.

Referring to FIG. 2, a player account record 201 is stored in memory 121. Record 201 is associated with a particular player ID number. Record 201 includes various data including player name data 203. Other data 205 indicates the total number of points in the player's account. This points number data 205 will change as a player gains points by, for example, activity at a gaming location. Also, points number data 205 will decrease in value due to conversion of points for cash, complementaries or play.

Points are awarded to a player based on criteria established, for example, by the operator, at kiosk 161. For example, one point may be awarded for every 10 coins wagered at the gaming location. The meeting of this criteria is determined by the central authority 120 which monitors the coin-in data that it receives from interface 112. For example, when central authority 120 receives data that 400 coins have been played, the central authority will add 40 points to the player's account.

Alternatively, where a gaming location is a table game, the time of play may be entered by a casino employee at the gaming location, which is then sent to central authority 120. The central authority may then determine points based on the product of time played and a preset constant indicative of typical bet amount per amount of time.

Referring again to FIG. 2, tiered award data 207 is associated with a player's account, and is stored in memory 121. Separate tiered award data 207 is established for each player that participates in the tiered reward promotion. Data 207 represents a value which quantifies a player's activity. For example, data 207 represents the number of points achieved by the player during a bonus period. At the end of the bonus period, CPU 122 of the central authority reads data 207 to obtain the number of the points achieved. Data 207 is then reset to a zero value to make it ready to increase in value to indicate accumulated points for the next bonus period. The number of points represented by data 207 may be different than the points number data 205 in the player account, since the points number data 205 may be converted for comps, etc. at a time during the bonus period. In addition, the points which increment data 207 may be based on criteria different from points number data 205.

For example, points which increment data 207 may be based on points earned, coin-in, coin-out, theoretical win, actual win, comp dollars earned, time played, average bet, etc. Through interactive prompts at workstation 161, the operator sets the criteria, thus establishing the particular parameter (or parameters) that will be monitored by the central authority. Where the selected criteria is points, central authority 120 adjusts data 207 to keep track of points achieved by the player as data messages from gaming locations are sent to the central authority.

Where the criteria is time played, for example, CPU 122 keeps track of time based on card-in and card-out. For example, each minute that the player card remains inserted in reader 150 will cause data 207 to increment in value by a fixed amount. This minute data may be adjusted based on number of games played, for example.

In another example, where the criteria for data 207 is average bet, CPU 122 keeps track of total dollars bet and number of bets. The value represented by data 207 is the average bet which fluctuates as bets are made. As will suggest itself, instead, two separate data 207 may be used to track two parameters. One data 207 tracks total dollars and another data 207 tracks number of bets.

In some cases, the operator may select only certain types of gaming to compete in the tiered reward promotion. For example, the operator may establish that only points received from play on slot machines and blackjack tables are used to increment the value of data 207. Through interactive prompts at work station 161, the operator selects which type of gaming will be monitored for the tiered reward promotion.

Figure 3:
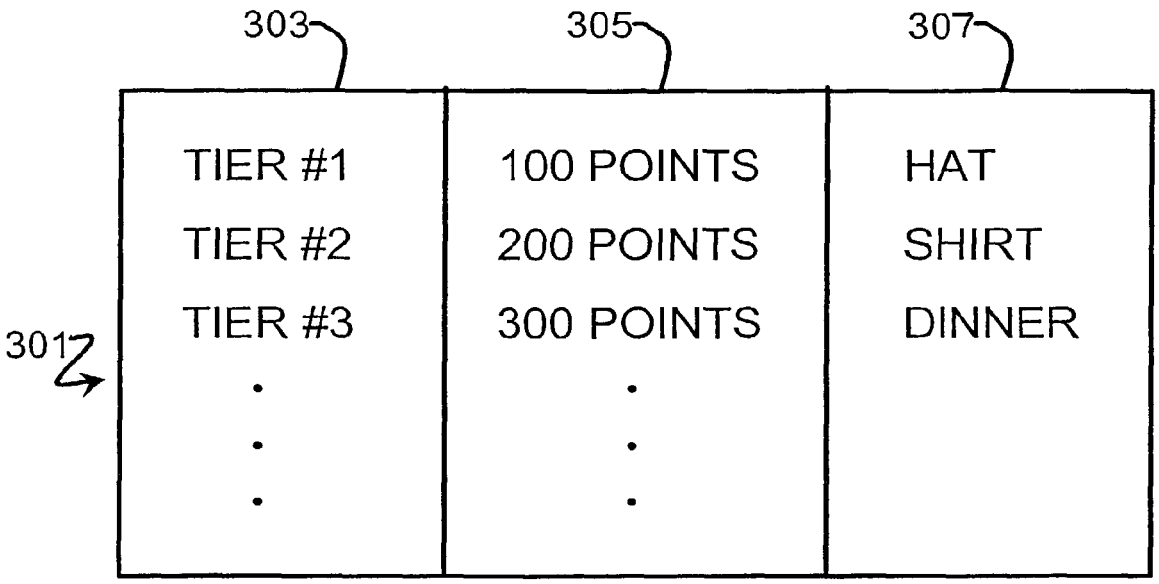
FIG. 3 is a block diagram representation of data stored in memory in the gaming system of FIG. 1.

As shown in FIG. 3, a memory location 301 is established in memory 121 of the central authority. Memory location 301 is programmed by the operator in order to (1) establish the number of ranks in the tiered reward promotion, (2) the activity needed to reach each rank, and (3) the award won for each rank reached by a player.

A separate memory location 301 is established for each tiered reward promotion. For example, a daily award promotion may require lower thresholds for each rank than a yearly award promotion. In addition, a daily promotion may require only four or five tiers, whereas an annual promotion may require, for example, 25 tiers. As will suggest itself, two or more different daily promotions may be run simultaneously, with different players assigned to different promotions. For example, newly carded players may be entered in a separate daily promotion. The prompts thus allow for programming of a separate memory location 301 for each promotion established by the operator.

As will further suggest itself, a plurality of data 207, each representing a separate value, may be associated with the same player who competes in more than one promotion simultaneously. As shown in FIG. 2, a number of data 207, 207*a*, 207*b*, will be used, each for one tiered reward promotion. For example, a player may participate in both a daily award program and an annual award program; then data 207 indicates accumulated points toward the daily award and data 207 indicates accumulated points toward the annual award.

Through interactive prompts at work station 161, the operator establishes the number of ranks (or what may be called tiers or levels) 303 (FIG. 3) in the particular reward promotion. As an example, the operator may set only three ranks to be active in a tiered reward promotion.

After setting the number of ranks, the operator establishes the activity level 305 that corresponds to each tier that must be achieved during the award time period to reach that tier. For example, the activity may be quantified in terms of points. The first rank, shown as Tier #1 in FIG. 3, may be programmed as a rank of activity between 100 and 199 points. The operator programs the lower threshold of Tier #1 rank to 100 points. Tier #2 rank may be programmed as a rank of activity between 200 and 299 points. The operator programs the lower threshold of the Tier #2 rank to 200 points. And tier #3 rank may be programmed as a rank of activity between 300 and greater points. The operator programs the lower threshold of the Tier #3 rank to 300 points. As understood, activity quantifications other than points may be used.

After establishing the threshold of activity required to reach each rank, the operator then establishes the particular award 307 that corresponds to each rank, i.e., the award that will be won if the player reaches the associated rank. Through prompts at work station 161, the operator establishes award indicators 307 in memory location 301. These award indicators 307 are terms used in establishing the promotion in order to indicate the particular bonus award to be given.

As shown in FIG. 3, an award indicator 307 is "HAT". The term "HAT" is set by the operator to correspond to the Tier #1 rank of 100-199 points, and indicates that a hat will be the bonus award. Thus, if the player's activity reaches a threshold of 100 points, the player is awarded a hat. Other award indicators shown in FIG. 3 include the term "SHIRT" and the term "DINNER".

Award indicator 307 may be selected from a pre-established list of possible award indicators that identify the awards that may be won in a promotion. For example, the operator may choose an award indicator 307 from a table of one hundred different award indicators that are preset in memory 121. The one hundred preset award indicators may be arranged in award value so that the operator can easily select an appropriate award for each rank. The awards selected for each rank should increase in value as the corresponding rank increases. Thus, a Tier #5 award is of more value than a Tier #4 award.

Software is executed by CPU 122 to update data 207 for each player as, for example, points are earned. Points are accumulated in the interface 112 during play of the gaming machine. Upon removal of the player card ("card-out"), the interface 112 sends the number of the points earned (that have not been previously sent) to central authority 120. If the player card remains in the gaming machine for more than one hour, after each hour of play, the interface 112 sends the number of the points earned during the last hour to the central authority. When the central authority receives a data message from interface 112 informing as to the number of points to be added to the player's account, data 207 is incremented with that number of points.

As understood, the particular selection of criteria to quantify player activity, by interactive prompts at workstation 161, serves to select the particular software which manages the accumulation of value represented by data 207. For example, where the operator selects coins-out as the criteria for the tiered reward promotion, CPU 122 monitors the coin-out data in messages received from the gaming locations and increments each data 207 of the one or more player accounts accordingly.

Figure 4:
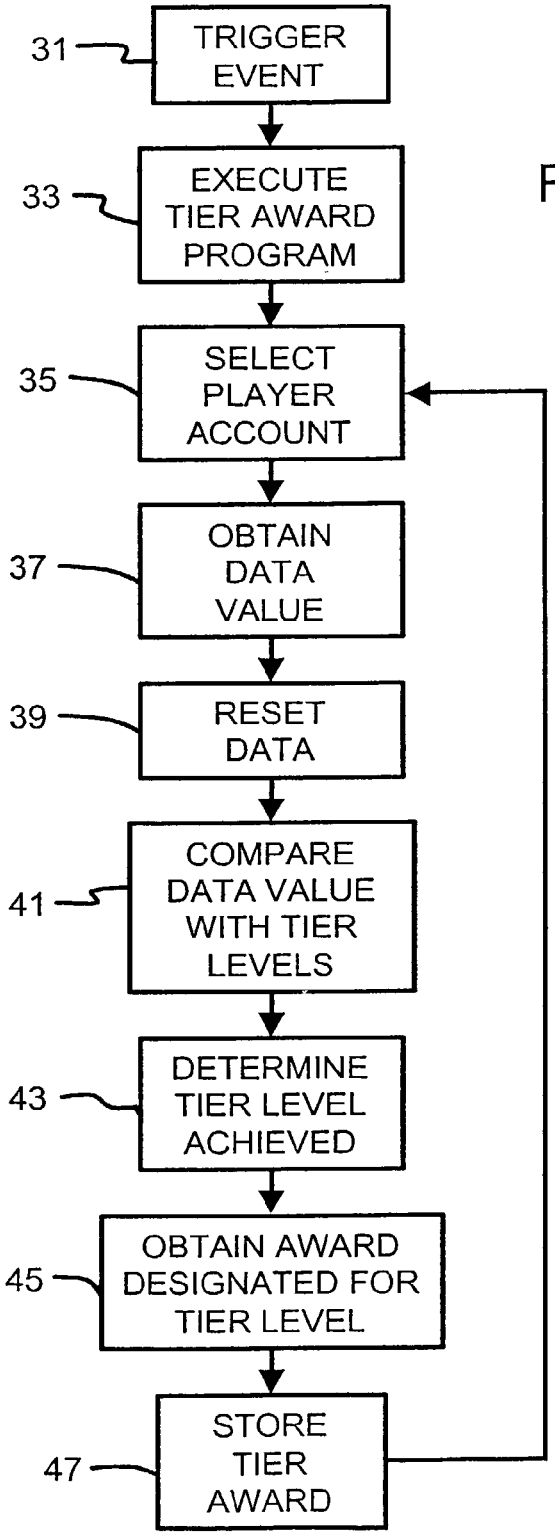
FIG. 4 is a flow diagram of a tier award method in the gaming system shown in FIG. 1.

Referring to FIG. 4, flow block 31 represents the occurrence of a trigger event. The purpose of the trigger event is to provide an end point to the time period of the tiered award program. At the end point, a determination is made as to whether a tier award has been achieved by one or more players which are associated with that particular promotion. The trigger event may be a specific time each day, for example, at midnight. Alternatively, the trigger event may be scheduled for a specific time and date, for example, Jul. 26, 2002 at 3:00 p.m.

The casino operator of the system establishes the trigger event using work station 161. The trigger event is programmed by the operator through interactive menu prompts. In response to the prompts, the operator keys in a trigger event. For example, the menu prompt requests the operator to select the type of time period or event that will generate the trigger event. The prompt may provide a list from which the operator may select the triggering event. For example, the prompt list may include (1) a specific date, (2) daily, (3) weekly, (4) monthly, (5) annual, (6) a per trip time period or (7) a per session time period.

If the operator selects a specific date, then the system prompts the operator to key-in the month, day, year and time of the day. The trigger event will then occur on the date and time selected.

Alternatively, if the operator selects a daily time period, the system may be set to default to midnight each day thereafter. Instead of a midnight default, the system may be settable by prompts to a specific time of the day which is entered by the operator. The trigger event will then occur every day at the time selected.

If the operator selects a "weekly" time period, then the operator may be prompted to enter the start date and end date, e.g., Jun. 16, 2002 and Jun. 29, 2002. At midnight on Saturday of each week between these dates, a trigger event will occur. The trigger event will occur once every week until the end date occurs.

If the operator selects a "monthly" time period, then the particular start month is entered by the operator, e.g., March. Then, at midnight on the last day of each month beginning with March (the next time March 31 occurs) a trigger event will occur. The trigger event will occur once every month starting with March.

If the operator selects an "annual" time period, then the operator is prompted to enter a particular year, e.g., 2002. Then, at midnight on December 31, of each year beginning with 2002, a trigger event will occur. The trigger event will occur at the end of every year starting with 2002.

If the operator selects per trip, then the trigger event will occur at the end of the player's trip. That end-of-trip point may be entered into the system by the operator who obtains this information directly or indirectly from the player. Alternatively, this departure date can be entered directly from the player by a prompt on a display at the gaming machine or gaming location first attended by the player using his or her player card. Alternatively, the date of departure can be taken as midnight of the player's check-out day stored in the hotel computer system or database. Alternatively, the system can detect when the player has not used a player card for a period of two days, for example, and cause the trigger event to occur.

If the operator selects a per session time period, then the trigger event is taken as the time of card removal from card reader 150 at a gaming location. For example, a player plays a gaming machine for three hours and then removes his or her player card. At the time of removal of the player card, a trigger event will occur.

As will be appreciated, other times may be set as the trigger event. In addition, random events may be used as the trigger event, including the event of the first player of a group of players to reach 1000 points, or the first player of a group to obtain winnings totaling more than $500.00.

The system must monitor the occurrence of the trigger event in accordance with the particular event selected by the operator. If a date or time is selected, then the central authority monitors a clock/calendar program.

If a per session time period is selected, then a message from the game location which is transmitted to the central authority at card-out is monitored. For example, a points update message which is sent to the central authority 121 on card-out. Alternatively, interface 112 may be programmed to send a separate message to the main computer at the time that a player card has been removed. That card-out message may be monitored as the trigger event.

If a random event is selected, then CPU 122 must determine when that random event occurs. For example, this may be done based on its own processing, e.g., the first player to reach 1000 points. It also may be done in accordance with information sent to CPU 122 by interface 112.

Referring again to FIG. 4, a flow block 33 represents the execution of a software program by CPU 122 of the central authority. This software program determines the specific bonus award that the player achieved at the time of the trigger event. Upon detection of the trigger event, the software program in memory 121 is executed by CPU 122.

Initially, at step 35, a single player account is selected from among all of the player accounts that are associated with the particular trigger event that occurred, per block 31. The CPU 122 keeps track in memory 121 of player participation in the tiered reward promotion. Operator interaction at workstation 161 allows selection of the participating players for each promotion. Thus, some players may be eligible for a daily tiered reward, whereas other players may be eligible for a weekly tiered reward, and so on. When the trigger event occurs, the program determines which players have been selected for participation in the promotion, and begins with one of those players at step 35.

At step 37, the value of data 207 (FIG. 2) of player's account is obtained. The data 207 is the data associated with the particular promotion. As described above, this value represents the total number of points, for example, earned during the bonus period by the particular player.

As explained above, two parameters may be monitored using two separate data 207. If that is the case, then the values of both data 207 are obtained and processed to generate a single value indicative of a rank, in step 37.

Data 207 is reset at step 39 to a zero value making the data 207 ready for the next reward period. The resetting of data 207 may serve to initiate the next bonus period, for example where the promotion is daily and the trigger event is midnight. Alternatively, after reset of data 207, a separate trigger event causes the bonus period to be initiated and causes the CPU 122 to begin its program of incrementing the value of data 207.

At step 41, the value obtained in step 37 is compared to the activity level 305 (FIG. 3) to determine which rank 303 was achieved by the player. For example, if the value obtained in step 37 is 275 points, then the player achieved Tier #2 rank, but did not reach Tier #3 rank.

At step 41, the program compares the value obtained in step 37, for example, 275 points, with the activity value 305 for Tier #1 rank and so on for each rank in order until the activity value 305 is a value greater than the value obtained in step 37, e.g., a value greater than 275. In this example, the activity value of 300 points would be the activity level at which the Tier rank is too great. Then, in step 43, the program determines that the player reached Tier #2 rank.

In step 45, the program searches the database for the award indicator 307 that has been assigned to Tier #2 rank. As indicated in the FIG. 3 example, the term "SHIRT" has been assigned to Tier #2 rank. Thus, the bonus award is a shirt which corresponds to the term "SHIRT."

At step 47, the program stores an indication of the bonus award that was won by the player in the player's account 201 (FIG. 2) at a memory location 209. Thus, a term, for example, the word "shirt" is displayed on the display of kiosk 163 when the player examines his or her account to visually indicate that a bonus award of a shirt has been won by the player.

Next, the program returns to step 35 and selects the next player account that is associated with the particular promotion that was completed by the trigger event detected at block 31. Steps 37 through 47 are then repeated for that player. This process continues until all players participating in the promotion have been processed.

After winning a tiered reward, the player may go to a kiosk redemption area to obtain the award or a voucher for the award. For example, a redemption kiosk 163 is located on the casino floor. At kiosk 163, the player inserts his or her player card into a card reader, similar to card reader 150. The player interacts with the kiosk through prompts on a display similar to display 118. The player can obtain a voucher for the shirt, for example, won in the tiered reward promotion. Kiosk 163 obtains the award information from player account 203 and generates a printed voucher which is dispensed to the player. The player may take the voucher to the gift shop, for example, and redeem the voucher for the shirt.

Those skilled in the gaming and computer arts are able to program the interfaces and central authority to provide the displays and interactivity described in the accompanying drawings and described in this specification.

While the invention has been described with reference to one or more preferred embodiments, those skilled in the art will understand that changes may be made and equivalents may be substituted without departing from the scope of the invention. In addition, many modifications may be made to adapt a particular step, structure, or material to the teachings of the invention without departing from its scope. Therefore, it is intended that the invention not be limited to the particular embodiment disclosed, but that the invention will include all embodiments falling within the scope of the appended claims.

The invention claimed is:

1. In a gaming system comprising (i) a network, (ii) a central authority comprising a processor and transitory memory having a plurality of memory locations, (iii) a gaming location having a credit input mechanism configured to accept a physical item associated with a monetary value for establishing a credit balance, the credit balance being increasable and decreasable based at least on wagering activity, a payout mechanism configured to cause a payout associated with the credit balance, and a game playable by a player, and a communication unit, and (iv) a workstation having a workstation communication unit in communication with the central authority, a method of providing a bonus award to the player based on the extent of play of the game at the gaming location, comprising:

establishing a credit balance at the gaming location via said credit input mechanism receiving the physical item;

receiving at the workstation communication unit data indicative of a definition of a plurality of tiered reward programs including selecting at the workstation a number of tiers for each tiered reward program;

assigning to said player one or more tiered reward programs of the defined plurality of tiered reward programs, and permitting assigning the defined plurality of said tiered reward programs to said player;

for each of the tiered reward programs assigned, selecting a plurality of criterion at the workstation from a selection of criteria to quantify player activity;

storing a plurality of tier values corresponding to a respective criterion selected at the workstation for said one or more tiered reward programs in the memory, at least one tier value for one of said reward programs being different than all tier values for another of said reward programs;

storing a plurality of award indicators in the memory, said step of storing award indicators including associating each award indicator with one of said plurality of tier values;

enabling a play of a game at the gaming location;

transmitting activity data from the communication unit to the central authority via the network, wherein said activity data comprises at least a first parameter that represents at least one of (i) amount wagered at the gaming location and (ii) time played at the gaming location, and wherein said first parameter is associated with a first parameter value that begins as a first defined value at a first bonus period start time and increases as said extent of play increases, and wherein said activity data further comprises at least one second parameter representing the player activity at the gaming location, said at least one second parameter being associated with at least one second parameter value that begins as a second defined value at a second bonus period start time, and said at least one second parameter is different from said at least one first parameter;

processing the activity data with the processor to determine a first rank indicative value, wherein said first rank indicative value is determined based at least in part on the respective selected criterion and at least in part on the change in the at least one first parameter value between the first bonus period start time and a first bonus period end time, wherein said first bonus period end time occurs in response to a first event that is independent of a first bonus award and is triggered at the gaming location, and wherein said first rank indicative value does not change in response to the player activity that occurs after said first bonus period end time, and further processing the activity data with the processor to determine a second rank indicative value, wherein said second rank indicative value is determined based at least in part on the respective selected criterion and at least in part on the change in the at least one second parameter value between the second bonus period start time and a second bonus period end time, wherein said second bonus period start time occurs before said first bonus period end time, and wherein said second bonus period end time occurs after said first bonus period start time;

after determining the first rank indicative value, resetting said at least one first parameter value to said first defined value;

determining a first particular tier value based at least in part on a comparison between the first rank indicative value and the tier values for the first reward program;

indicating a first award associated with said first particular tier value as said first bonus award;

allowing a redemption of said first bonus award at the payout mechanism after said indicating of a first award; and after determining the second rank indicative value, (i) determining a second particular tier value based at least in part on a comparison between the second rank indicative value and the tier values for the second reward program; and (ii) indicating a second award associated with said second particular tier value as a second bonus award.

2. The method according to claim 1, wherein the first bonus period end time is triggered at the gaming location electing to trigger the first bonus period end time.

3. The method according to claim 1, wherein the first bonus period end time is triggered at the gaming location concluding a player wager session.

4. The method according to claim 1, wherein the first bonus period end time is triggered by a departure date.

5. The method according to claim 4, further comprising entering said departure date into the gaming system.

6. The method according to claim 4, further comprising receiving an election of said departure date from an operator.

7. The method according to claim 1, wherein said first rank indicative value is a number of points.

8. The method according to claim 1, further comprising allowing said player to redeem said second bonus award after said indicating a second award.

9. The method according to claim 1, wherein said first defined value is zero.

* * * * *